United States Patent [19]

Ayers

[11] Patent Number: 4,708,345

[45] Date of Patent: Nov. 24, 1987

[54] MANIPULATIVE AMUSEMENT DEVICE

[76] Inventor: David B. Ayers, 13908 Cravenridge Dr., Houston, Tex. 77083

[21] Appl. No.: 816,450

[22] Filed: Jan. 6, 1986

[51] Int. Cl.[4] ..... A63F 9/08

[52] U.S. Cl. ..... 273/153 S; 273/155; 434/174

[58] Field of Search ..... 273/153 S, 155; 434/174

[56] References Cited

U.S. PATENT DOCUMENTS

| | | | |
|---|---|---|---|
| 3,010,227 | 11/1961 | Glass | 434/174 |
| 3,239,951 | 3/1966 | Benson | 434/174 |

FOREIGN PATENT DOCUMENTS

| | | | |
|---|---|---|---|
| 3221120 | 12/1983 | Fed. Rep. of Germany | 273/153 S |
| WO83/01009 | 3/1983 | World Int. Prop. O. | 273/153 S |
| 2116049 | 9/1983 | United Kingdom | 273/153 S |
| 2121693 | 1/1984 | United Kingdom | 273/153 S |
| 1117069 | 10/1984 | U.S.S.R. | 273/153 S |

*Primary Examiner*—Anton O. Oechsle

*Attorney, Agent, or Firm*—Robert M. Carwell

[57] ABSTRACT

An amusement device for use in providing a manipulative puzzle, word games, games of chance, scoring games, or the like. Upper and lower parallel plates are planarly rotatable about a vertical axis. A plurality of cylinder assemblies is carried by the plates disposed on the outer periphery such that their longitudinal axes intersect to define a regular polygon parallel to the plates. Means are provided for maintaining spatial position of the upper one-half of each cylinder assembly relative to the upper plate, and the lower one-half of each cylinder assembly relative to the lower plate as the plates are rotated in opposing directions. When the plates are rotated such that the upper and lower cylinder halves combine to define the cylinder assemblies, each such assembly is further rotatable about its longitudinal axis. Each cylinder is comprised of sections each preferably having an identifier on its outer surface such as a different color or the like. Repeated rotation of the plates and cylinder assemblies permits formation of such assemblies from any combination of cylinder sections. When the combinations of cylinder sections are randomized, such repeated rotations may result in forming a preselected pattern of such identifiers to solve a puzzle as, for example, in forming a plurality of cylinder assemblies each with a different uniform outer surface color.

20 Claims, 9 Drawing Figures

MANIPULATIVE AMUSEMENT DEVICE

FIELD OF THE INVENTION

This invention relates to amusement devices and, more particularly, relates to such devices of the manipulative type for use in providing puzzles or the like.

BACKGROUND OF THE INVENTION

Amusement devices have long been known in the art which provide a plurality of individual components which may be spatially positioned relative to one another to define various preselected geometrical shapes, surface configurations, or the like. A familiar example of this may be seen in the device popularly known as the Rubik's Cube, a representative example of which is disclosed in U.S. Pat. No. 4,378,116 to Erno Rubik and entitled "Spatialogical Toy". Yet another such example may be further seen depicted in United Kingdom patent application No. GB2116049A entitled "Manipulative Puzzle" to Wayne Butler. Whereas such devices have gained extensive commercial acceptance, each suffers from its own unique deficiencies impairing their versatility and facility for which they are used.

For example, typically there is no convenient means provided for defining the relative spatial positioning of various components of the puzzles so as to facilitate solution by means of a solution book or the like. Moreover, in order to provide such devices with increased complexity of puzzles, characteristically such apparatus has added increased levels of mechanical complexity to achieve this goal, resulting in undesirable increase in manufacturing costs and the like. Still further, such amusement devices are frequently awkward to manipulate, and further have failed to exploit the wide variety of game possibilities such as the creation of word games or alphanumeric games by capitalizing on the wide variety of relative spatial positions possible between the various component parts and by interrelating such parts in novel manners.

Yet an additional deficiency of many such devices relates to embodiments thereof wherein some form of color coding or the like exists on the outer surface of the manipulated pieces. Typically the outer exposed faces of various puzzle pieces are of differing colors for purposes of forming various preselected color patterns or the like in solution of the puzzles. In many of the prior art embodiments of such manipulative devices, individual colored pieces of the device have planar surfaces which intersect wherein each planar surface must be of a different color. An example of this may be seen in the aforementioned Rubik's cube wherein the corner pieces of the puzzle have three sides which must each be of a different color in order to provide for a cube having six faces each of a different color upon solution of the puzzle. Such requirement for individual puzzle pieces having different colors or other indicators on differing faces of the same puzzle piece have obvious attendant manufacturing difficulties, requiring that the separate exposed faces be colorized in an additional manufacturing step by means of painting, stick-on labels, or the like. Thus, it would be highly desirable, by an appropriate design feature, to provide for puzzle piece segments which, for example, may be molded so that their exposed faces need only be of one color, thereby permitting a one-step manufacturing process for each such puzzle piece wherein it is molded in its entirety of a different colorized plastic.

Still an additional drawback of many such manipulative devices and puzzles relates to the fact that during such manipulation they are silent. Thus, it would be highly desirable to provide for various designs wherein some form of aural indicator simulates the noise or other sound commonly associated with the outward appearance of the common mechanical device simulates by the toy. Thus, for example, it would be highly desirable to provide for such an amusement device which, in outward appearance, simulated appearance of a TV channel changer, a roulette wheel, the knob of a safe or the like, and wherein, more particularly, manipulation of the amusement toy as, for example, in rotation of the safe knob, created a sound mimicking the sounds associated with rotation of an actual safe knob.

SUMMARY OF THE INVENTION

An amusement device for use in providing a manipulative puzzle, word games, or the like. Upper and lower parallel plates are planarly rotatable about a vertical axis. A plurality of cylinder assemblies is carried by the plates disposed on the outer periphery such that their longitudinal axes intersect to define a regular polygon parallel to the plates. Means are provided for maintaining spatial position of the upper one-half of each cylinder assembly relative to the upper plate, and the lower onehalf of each cylinder assembly relative to the lower plate as the plates are rotated in opposing directions. When the plates are rotated such that the upper and lower cylinder halves combine to define the cylinder assemblies, each such assembly is further rotatable about its longitudinal axis. Each cylinder is comprised of sections each preferably having an identifier on its outer surface such as a different color or the like. Repeated rotation of the plates and cylinder assemblies permits formation of such assemblies from any combination of cylinder sections. When the combinations of cylinder sections are randomized, such repeated rotations may result in forming a preselected pattern of such identifiers to solve a puzzle as, for example, in forming a plurality of cylinder assemblies each with a different uniform outer surface color.

These and other deficiencies of the prior art are overcome with the present invention, as shown by the accompanying drawings.

DETAILED DESCRIPTION OF THE INVENTION

Figure 1:
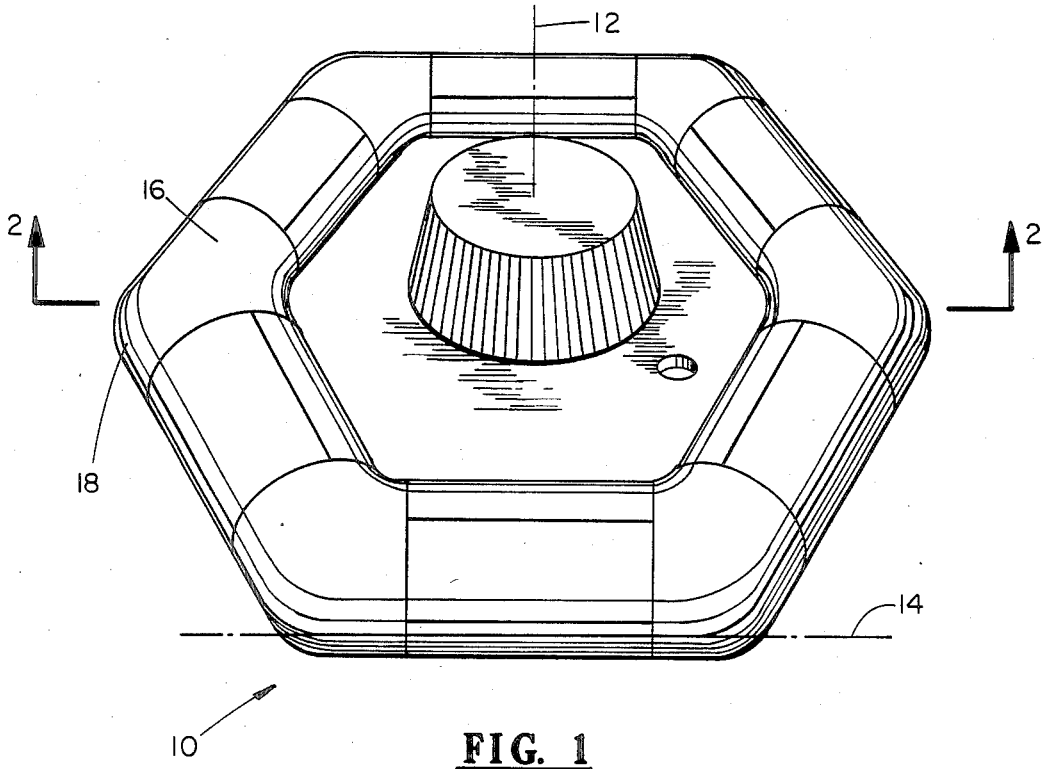
FIG. 1 is a pictorial illustration of a preferred embodiment of the manipulative toy of the present invention.

Referring first to FIG. 1, there will be seen depicted therein generally a preferred embodiment of a manipulative amusement device 10 of the present invention. The device may be seen to be generally symmetrical about a central vertical axis 12 and is generally comprised of an upper and lower assembly 16 and 18, respectively, lying respectively above and below a horizontal plane 14 perpendicular to the aforementioned axis 12.

Figure 2:
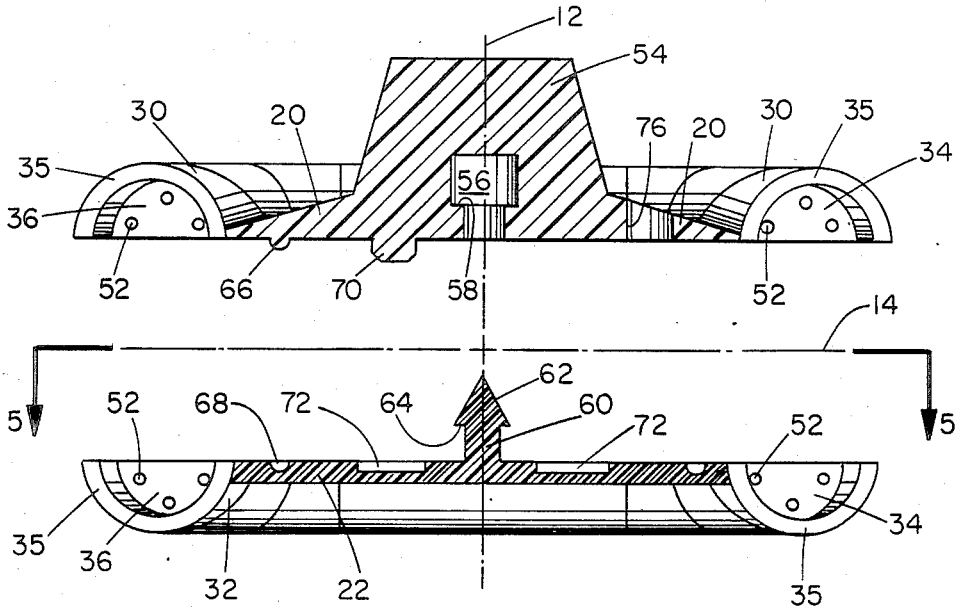
FIG. 2 is an elevational view, in section, taken along line 2—2 of the invention illustrated in FIG. 1.

These upper and lower assemblies 16 and 18 may be seen more clearly with respect to the elevational view of FIG. 1 taken along line 2—2 as depicted in FIG. 2 and hereinafter described in greater detail.

Figure 3:
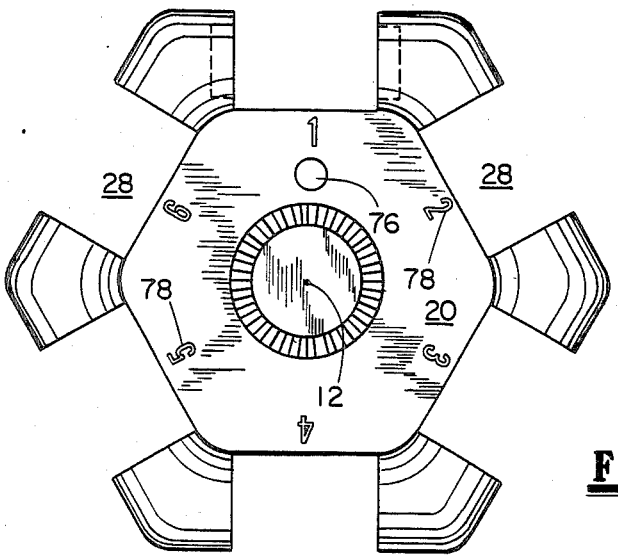
FIG. 3 is a top plan view of a portion of the upper assembly of the invention depicted in FIG. 1.
Figure 4:
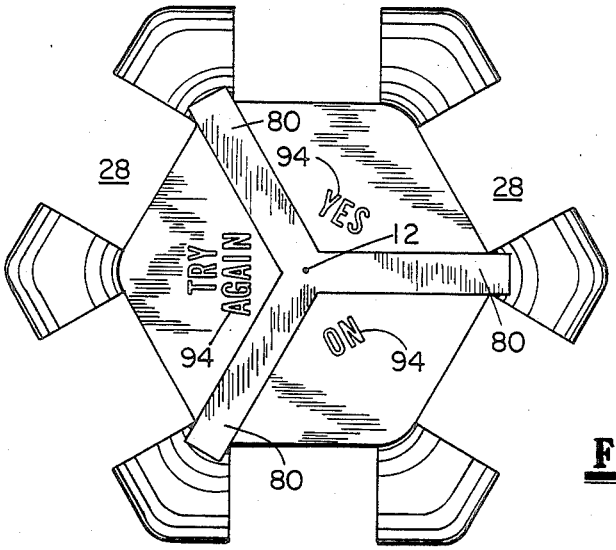
FIG. 4 is a bottom plan view of a portion of the lower assembly depicted in FIG. 1.

With respect to FIGS. 2, 3, and 4, an upper plate 20 and lower plate 22 are provided which, in assembly, will be generally disposed parallel to one another. Each plate 20 and 22 will have disposed on the outer periphery thereof a plurality of half-cylindrically-shaped collar portions forming a plurality of collar portions 24 when the upper and lower plates 20 and 22 are aligned about the axis 12 so as to bring respective half-cylinder sections into vertical alignment with one another as depicted in FIG. 7.

Comparison of FIGS. 3 and 4 indicates that in each upper and lower plate 20 and 22 a plurality of rectangularly-shaped openings 28 are disposed in the outer edges thereof when viewed from above and below. With respect to the upper plate 20, on either end of each opening 28, an upper collar piece 30 in the shape of the aforementioned half-cylinder is provided. In like manner, with respect to the lower plate 22, on either end of the openings 28 therein, a lower collar piece 32, also in the aforementioned half-cylindrical shape, will be provided, such upper and lower collar pieces 30 and 32 when aligned in vertical registry forming the previously described collar members 24.

Figure 6A:
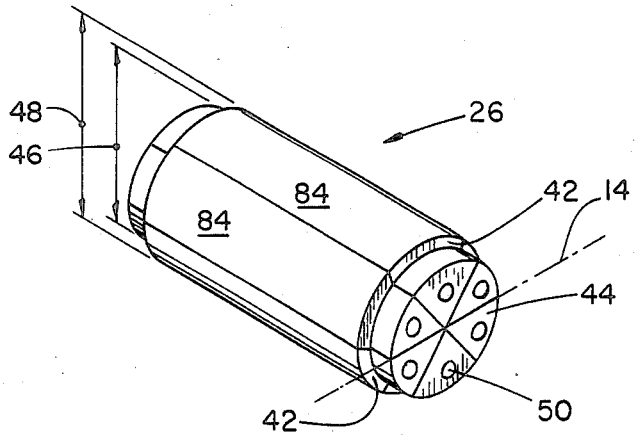
FIG. 6A is a pictorial illustration of a representative cylinder assembly comprising a portion of the invention depicted in FIG. 1.
Figure 6B:
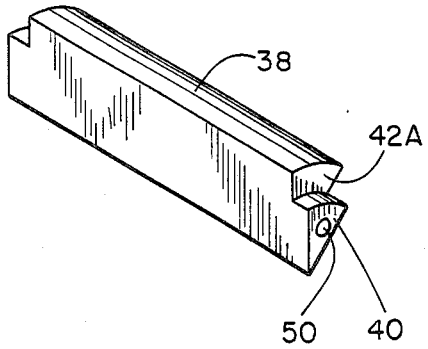
FIG. 6B is a pictorial illustration of a representative section member of the cylinder assembly depicted in FIG. 6A.
Figure 7:
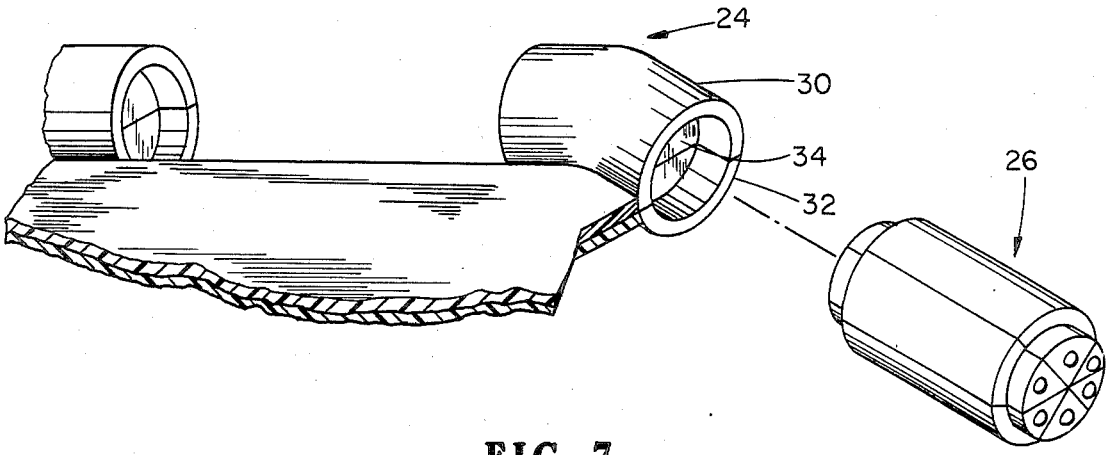
FIG. 7 is a pictorial assembly illustration, partly in section and depicting an exploded view of a portion of the invention depicted in FIG. 1.
Figure 8:
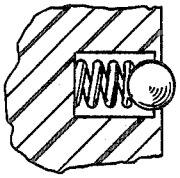
FIG. 8 is a side view, partly in section, illustrating a portion of the registry means employed in the invention depicted in FIG. 1.

In FIG. 7 as well as FIG. 2, it will be noted that with respect to each collar member 30, at either end of the cylindrical shape thereby formed, a respective first and second recess 34 and 36 are formed therein, each for receiving a respective end of one of the cylinder assemblies 26 depicted in FIGS. 6A and 7. Referring more particularly now to these cylinder assemblies 26, and with more particular reference to FIGS. 6A and 6B, the cylinder assemblies 26 will be seen to include generally ring-shaped shoulders 42 disposed at either end thereof for abuttingly engaging mating ring-shaped faces 35 of each collar member 24. Moreover, the ends of each cylinder assembly 26 further will preferably include an end disk 44 matingly and rotatably received, respectively, by the aforementioned first and second recesses 34 and 36 in the collar members 30. Accordingly, it will be noted that the end disks 44 will have a first diameter 46 substantially equal to that of the first and second recesses 34 and 36. The ring-shaped shoulder surfaces 42 will, in like manner, define a second diameter 48 slightly larger than that of the first diameter 46 so as to permit such shoulders 42 to slidingly and abuttingly engage their respective faces 35 of the collar members 30 as previously described.

It will be noted that each cylinder assembly 26 is comprised of a plurality of identical cylinder sections 38, a representative one of which may be seen illustrated in FIG. 6B. With respect to each such section 38, a section shoulder 42A is provided and a pie-shaped end section 40. By orienting a plurality of such sections 38 about a common longitudinal axis, it will thus be appreciated that each such shoulder section 42A and end section 40 will collectively define the aforementioned ring-shaped shoulders 42 and end disks 44. Each end section 40 will also preferably further include a small raised hemispherically-shaped nub 50 for purposes to be hereinafter described.

With reference back to FIG. 2, the upper plate 20 may preferably have disposed thereupon a knob 54 coaxially aligned with the central longitudinal axis 12 and integrally connected with the upper plate 20. Moreover, this knob 54 will preferably define an internal recess 56 which includes a shoulder 58 lying in a plane substantially parallel to plane 14. A comparison of this recess 56 in the upper plate 20 with the lower plate 22 in FIG. 2 indicates that the lower plate 22 may preferably include a connecting extension 60 for mating engagement with the aformentioned recess 56. More particularly, the extension 60 will extend in the direction of the vertical axis 12 and in coaxial alignment therewith and will include a pointed tip 62 portion and further defined a ring-shaped shoulder 64. By bringing the upper and lower plates 20 and 22 together along axis 12, the plates may be brought into mating engagement whereby the tip 62 is disposed within the recess 56 with the shoulder 64 in axis 12.

Figure 5:
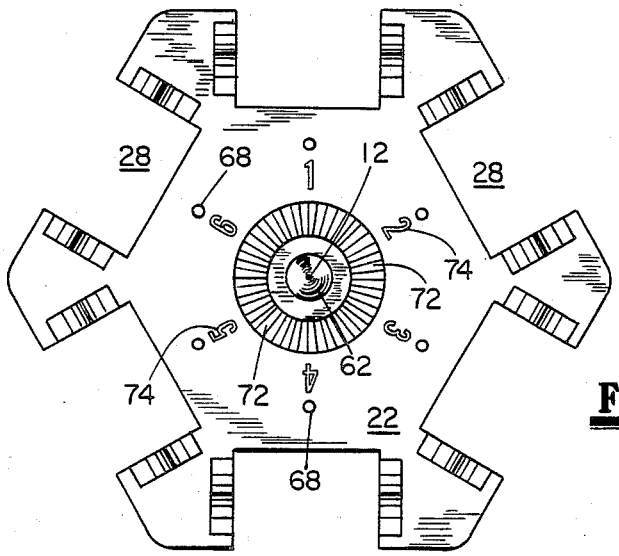
FIG. 5 is a top plan view of the portion of the invention depicted in FIG. 4

A comparison of FIGS. 2 and 5 reveals that the lower plate 22 will further have disposed about the connecting extension 60 a ring-shaped plurality of ribbings 72 recessed into the face of the lower plate 22 and extending in a generally radially outwards and upwards direction. Referring back to FIG. 2, a tab 70 will further be included which is pendantly disposed downwards from the lower surface of the upper plate 20. Upon bringing the upper and lower plates into rotatable making engagement as aforesaid, as such relative rotation occurs between the upper and lower plates 20 and 22 about the axis 12, the tab will successively contact each of the plurality of ribbings 72, thereby creating an audible clicking noise. This simulates the audible sounds of the tumbler mechanism or the like in safe locks or other such devices.

A plurality of hemispherical recesses 52 shown in FIG. 2 receive the first hemispherical nubs 50 shown in FIG. 6B in each of the sections 38 for purposes of providing variable and releasable fixed positioning of the cylinders 26 about their longitudinal axes. A comparison of the nubs 50 on the cylinder segments 38 of FIGS. 6A and 6B with the recesses 52 in the faces of the collar members 24 illustrated in FIG. 2 will reveal the utility of such nubs 50 and recesses 52. It will be noted that the nubs 50 lie generally on a circle disposed about the longitudinal axis of the cylinder assembly 26. In like manner, the recesses 52 are disposed on circles about the longitudinal axis of the collar members 24. Moreover, the diameters of such circles of the nubs 50 and recesses 52 are substantially similar. In this manner, when the upper and lower plates 20 and 22 are aligned so as to cause the openings 28 to be in vertical registry to form the cylinder assemblies 26, the cylinder assemblies 26 may be rotated about their longitudinal axes so that the nubs 50 are in registry with respective matching recesses 52. This interrelationship between the nubs 50 and recesses 52 performs a function whereby the various cylinder assemblies 26 may be temporarily and releasably locked or positioned about their longitudinal axes and relative to the recesses 52. A significant benefit of such releasable locking means is as follows. When it is desired to relatively rotate in opposing directions the upper and lower plates 20 and 22, the various segments 38 of each cylinder assembly 26 must be positioned in a manner such that the plane 14 may bifurcate each cylinder 26 into an aforementioned upper and lower half-cylindrical section along edges of the cylinder segments 38. In this manner, rotation of the plates will permit separation of each cylinder 26 into the aforementioned half-cylindrical sections whereby the lower surface of the upper half-cylinders will ride along the upper surface of the lower plate 22, and the upper surface of the lower half-cylinder sections will slide along the lower surface of the upper plate 20. In other words, if the cylinders 26 are not so aligned, the upper and lower plates 20 and 22 will be prevented from the desired rotation caused by binding as, for example, by the undesirable abutting of the ring-shaped surfaces 42 of the cylinder segments 38 with the ring-shaped surfaces 35 of the collar members 24. It will now be appreciated that a purpose of the releasable locking means such as the nubs 50 and recesses 52 is to provide a tactile feedback to the player so as to facilitate the desirable rotational positioning of the cylinder assemblies 26 so that the rotation of the plates 20 and 22 may be effected. In other words, the player will, as he or she rotates the cylinder assemblies 26, may feel six distinct rotational positionings of the cylinders 26 about their longitudinal axes which will permit the rotation of the plates 20 and 22. Whereas the particular embodiment of the invention discloses nubs and recesses 50 and 52, respectively, it will be noted that the invention is not intended to be so limited. Accordingly, any convenient releasable locking and position-indicating mechanism may be provided whereby the operator can readily position the cylinder assemblies 26 in a manner so as to permit subsequent rotation of the upper and lower plates 20 and 22.

It will further be noted from FIG. 5 that disposed circumferentially about the vertical axis 12 of the lower plate 22, a plurality of second hemispherical recesses 68 will be provided positioned in the upper face of the lower plate 22. With reference to the upper plate 20 depicted in FIG. 2, a plurality of downwardly extending second hemispherical nubs 66 will be provided, also spaced circumferentially outwards in a circle about the vertical axis 12 and extending downwards from the lower face of the upper plate 20. It will thus be appreciated that when the upper and lower plates 20 and 22 are brought into mating rotatable assembly as aforesaid, the second nubs 66 and second recesses 68 will be in mating registry when the relative rotational position of the upper and lower plates 20 and 22 are as depicted in FIG. 1. In this manner, the nubs 66 and recesses 68 provide a tactile indicator as to when the sections 38 of the cylinder assemblies 26 are aligned so as to form the cylindrical shapes depicted in FIG. 1. Moreover, such mating registry serves as a releasable retention means for maintaining the assembly of sections 38 together to form the cylindrical assemblies 26.

Several additional novel features of the present invention may be noted with respect to the accompanying drawings. First, with reference to FIG. 5, it will be noted that a plurality of indicators 74 may be disposed on the inner and upper surface of the lower plate 22 circumferentially about the vertical axis 12. Such indicators 74 may take the form of any desired symbol such as alphanumerics, color dots, or the like. Moreover, a separate such indicator 74 may preferably be provided to correspond to each opening 28 in the lower plate 22 for purposes to be described shortly. With reference to FIG. 3, it will further be noted that an aperture 76 may be provided extending through the upper plate 20 and at a distance radially outwards of the vertical axis 12 substantially identical to the radial distance outward at which the aforementioned indicators 74 are spaced on the lower plate 22 from the vertical axis 12.

It will thus be appreciated that in this manner when the upper and lower plates 20 and 22 are rotated horizontally into positions such as that shown in FIG. 1 wherein the complete cylinder assemblies 26 are thereby formed, the aperture 76 in the upper plate 20 and one of the indicators 74 on the upper surface of the lower plate 22 may thereby be brought into vertical registry, whereby one of the indicators 74 may thus be readily viewed from above through the aperture 76. In the embodiment depicted and presently being described, six openings 28 are provided in the upper and lower plates 20 and 22 and six corresponding indicators 74. Accordingly, when the upper and lower plates 22 are horizontally aligned to form the cylinder assemblies 26, such alignment may be effected with six different relative positions between upper and lower plates 20 and 22. Further, with respect to each such relative position, a different indicator 74 will appear in the window or aperture 76. In this manner, a user may thus be provided with a sequence of manipulative instructions which might include a sequential list of numbers corresponding to the indicators 74. By successively positioning the specified indicators 74 in the aperture 76 by relative rotation of the upper and lower plates 20 and 22, the user may be assisted in solving puzzles or the like. With reference to FIG. 3, it will further be noted that a second plurality of indicators 78, which may also correspond to alphanumerics, color dot indicators, or the like, may be provided in the upper face of the upper plate 20. Each such indicator 78 may, in like manner to the indicators 74 of the lower plate 22, correspond to a different one of the openings 28 in the upper plate 20. Once the relative horizontal rotational positions of the upper and lower plates 20 and 22 are sequentially established (as, for example, by the aformentioned instruction set indicating a sequence of indicators 74 to appear in the aperture 76), a given cylindrical assembly 26 may further be identified by a further instruction set specifying particular second indicators 78. Yet a third set of such instructions may indicate which cylinder assembly or assemblies are to be rotated about their longitudinal axes and to what extent. Thus, by employing the aforementioned indicators 74, 78, and instructions on which cylinder assemblies 26 to rotate and how far, it is possible to define a sequence of "moves" which will sequentially vary which sections 38 will comprise each of the cylinder assemblies 26.

An excerpt of such an instruction set, greatly simplified for illustrative purposes, might read as follows:

"1. Rotate upper and lower plates 20 and 22 so as to position a numeral 1 in aperture 76.

2. Rotate the cylinder adjacent numerals 2 and 5 on the upper surface of upper plate 20 so as to position a blue section 38 of each such cylinder assembly 26 on the upper half-cylinders.

3. Rotate upper and lower plates 20 and 22 so as to next position a numeral 6 within the aperture 76.

4. Rotate all cylinder assemblies 26 so as to position a green section 38 in the upper half section of each cylinder assembly 36.
5. And so on."

In a simple illustration of the use of such instruction sets to provide a puzzle and its solution, it may be desirable in one embodiment of the present invention to provide cylinder assemblies 26 each of which are fashioned of an entirely different outer color. The sections 38 from each such cylinder assembly 26 may thence be randomizied by successive relative rotation of the upper and lower plates 20 and 22 and random rotation of various ones of the cylinder assemblies 26 when the plates are brought into mating registry as shown in FIG. 1. The player's task would then be to restore the order of the various cylindrical sections 38 whereby each cylinder assembly 26 is once again of an integral and different color. It will be appreciated that in this application, the variety of possible combinations of cylinder sections 38 is immense, and accordingly an instruction set as aforesaid may facilitate solution of the puzzle for the player.

Inasmuch as utility of the amusement device 10 is dependent upon repeated relative rotation of the upper and lower plates 20 and 22 as well as rotation of various ones of the cylinder assemblies about their longitudinal axes, it would be desirable to ease the manner in which such relative rotation of the plates is effected. Provision of a knob 54 integrally connected to the upper plate 20 has already been described. However, with reference to FIG. 4, which is a plan view of the lower surface of the lower plate 22, it will be appreciated that it may thus further be desirable to provide a plurality of partitions or raised ribbing 80 extending radially outwards of the central axis 12 of the lower plate 22. Thus, in manipulation of the amusement device 10, the user would preferably grasp the knob 54 with one hand and manually position digits of the other hand within the space between the ribbings 80 and in contact with the surfaces thereof, so as to facilitate the relative opposed rotation of the upper and lower plates 20 and 22.

With continued reference to FIG. 4, it will further be noted that with respect to each lower surface area defined between adjacent ribs 80, it may further be desirable to provide yet a third set of indicators 94 which, again, may be alphanumerics, phrases, color indicators, or the like. By providing a die or other means for random number selection, when such randomly selected numbers are positioned in the aperture 76 as aforesaid, this will position a different one of the third indicators 94 in vertical alignment with the aperture 76 which may thereby be treated by the player as the indicator 94 having been selected from the combination thereof by means of the random number. In the embodiment depicted in FIG. 4, these indicators 94 are phrases such as "Try Again", "Yes", or "No". As an illustration, if a player rolls a 2 with a die, the upper and lower plates 20 and 22 are rotated so as to position the "2" within the aperture 76. The particular one of the indicators 94 thereby positioned vertically below the aperture 76 by means of the relative rotation of the plates will then be treated as the selected one of the indicators 94 for purposes of continued play of the game.

Yet an additional feature of the present invention may be noted. It will be recalled that various indicators may be viewed on the upper portion of the amusement device 10 above the plane 14 independently and while out of view of various indicators positioned on the lower portion of the device 10 below the plane 14 and conversely. For example, various indicators including words, phrases, colors, numbers, or the like may be visible on the outer surfaces 84 of the uppermost half-cylinders formed by upper cylinder segments 38. In like manner, other such indicators 78 may be disposed upon and viewable on the upper surface of the upper plate 20. However, due to the general flat or planar arrangement of the device 10, other such indicators below the plane 14 may not be readily simultaneously viewable as, for example, with respect to indicators on the outer surface 84 of cylinder segments 38 comprising the lower half-cylinders disposed on the lower plate 22 as well as the previously described indicators 94 on the lower surface of the lower plate 22. Due to this feature, numerous additional amusement possibilities of the device 10 are possible. For example, in accordance with instruction sets, or random selectors such as dice, cards, or the like, or other such movement by the player, components of the device 10 such as the outer cylinder surfaces 38 or indicators 78 may be positioned and viewable by the player independently of the indicators 94 or those on the outer surfaces 84 of the segments 38 of the lower half cylinders. Thus, after such manipulative moves or observation of the indicators on the upper half of the device 10 above the plane 14, the device 10 may be turned over so as to view such indicators visible on the lower half of the device 10 in response and in relation to those visible on the upper half.

It has been previously noted that in one embodiment of the amusement device 10 of the present invention, the outer surfaces 84 of each cylinder section 38 may be preselected so that in assembly and in the correct combination, a plurality of cylinder assemblies 26 are thereby formed as depicted in FIG. 1, each being comprised of one integral color different from those of the remaining cylinder assemblies 26. However, in an alternate embodiment of the invention, as with the indicators such as indicators 74, 78, and 94, it may be desirable to provide on the outer surface 84 of each said section 38, either alone, or in combination with the aforesaid colors, either a unique number associated with each such section 38 or alphanumerics or even a word or phrase. The unique numbers appearing on each outer surface 84 of each section 38 may be used with the previously described instruction sets so as to be able to uniquely define by such instructions movement of any desired section 38 from one position to another position. However, with the provision of words or phrases on the outer surfaces 84 of the sections 38, yet an additional application of the device 10 may be provided.

In this application, sections 38 from different ones of the cylinder assemblies 26 may be combined to form phrases or sentences either by random positioning of the sections 38 or by intentional attempts to form intelligible phrases or sentences which are either preselected or improvised by the player as desired. As but one example, one possible phrase which may be formed by proper respective positioning of the various sections 38, in accordance with a list of such phrases which may be possibly formed, might be "Take Me Out To The Ballgame", such phrase may be considered to be formed by viewing all of the vertical-most outer surfaces 84 of the cylinder assemblies 26 as shown in FIG. 1. By scrambling or randomizing the combinations of the sections 38, the player's task might be to position each such section 38 so as to result in the aforementioned phrase.

Several variations on the aforementioned disclosure are possible and, accordingly, the invention is not intended to be so limited to the particular applications and embodiments herein depicted. For example, in the embodiment of FIG. 1, when the upper and lower plates 20 and 22 are aligned as illustrated therein, six cylindrical assemblies 26 are thereby formed, each being comprised, in turn, of six sections 38. Moreover, each cylinder assembly 26 is thereby positioned so as to define a regular polygon which, in this application, is a hexagon. However, either alone or in combination, it will be readily apparent that the cylinder assemblies 26 may be fashioned of a different number of sections as desired, lending to increased flexibility and complexity of the possible games. Still further greater or fewer numbers of such cylinder assemblies 26 may be provided, resulting in a polygon having sides other than the six described and depicted herein.

It is therefore apparent that the present invention is one well adapted to obtain all of the advantages and features hereinabove set forth, together with other advantages which will become obvious and apparent from a description of the apparatus itself. It will be understood that certain combinations and subcombinations are of utility and may be employed without reference to other features and subcombinations. Moreover, the foregoing disclosure and description of the invention is only illustrative and explanatory thereof, and the invention admits of various changes in the size, shape and material composition of its components, as well as in the details of the illustrated construction, without departing from the scope and spirit thereof.

What is claimed is:

1. A manipulative amusement device comprising:
an upper plate;
a lower plate parallel to and in coaxial alignment with said upper plate and rotatable relative to said upper plate;
each plate having a common centerpoint and including a plurality of openings on the outer periphery thereof alignable in vertical registry upon said relative rotation;
each plate further including a collar piece disposed on either side of each opening whereby when said openings are in said vertical registry, mating pairs of said collar pieces define a plurality of collar members each having a pair of recesses;
a plurality of cylinder assemblies each formed about a respective longitudinal axis and comprised of an even number of cylinder segments numbering at least six, said number being independent of the number of said plates; and
each said assembly having opposing end disks, each said disk being rotatably received by a respective one of said recesses and in coaxial alignment with said axis whereby each said cylinder assembly is rotatable about said axis and whereby said axes, in combination, circumscribe said common centerpoint.

2. The apparatus of claim 1, wherein said cylinder assemblies are disposable in said openings to define a polygon having at least three sides.

3. The apparatus of claim 2, wherein said upper plate includes a plurality of indicators each uniquely associated with a different one of said openings in said upper plate.

4. The apparatus of claim 3, wherein said indicators are each adjacent and radially inwards of a respective different one of said openings in said upper plate.

5. The apparatus of claim 4, wherein said lower plate includes a plurality of indicators each uniquely associated with a different one of said openings in said lower plate.

6. The apparatus of claim 5, wherein said indicators of said lower plate are each adjacent and radially inwards of a respective different one of said openings in said lower plate.

7. The apparatus of claim 6, wherein one of said upper and lower plates defines an aperture for viewing different ones of said indicators in the remaining one of said plates when said openings are in said vertical registry whereby said viewed indicators provide indication of relative rotational position of said upper and lower plates, respectively.

8. A manipulative amusement device comprising:
an upper plate;
a lower plate parallel to and in coaxial alignment with said upper plate and rotatable relative to said upper plate
each plate including a plurality of openings on the outer periphery thereof alignable in vertical registry upon said relative rotation;
each plate further including a collar piece disposed on either side of each opening whereby when said openings are in said vertical registry, mating pairs of said collar pieces define a plurality of collar members each having a pair of recesses;
said lower plate including a plurality of indicators each uniquely associated with a different one of said openings in said lower plate, said indicators of said lower plate being adjacent and radially inwards of a respective different one of said openings in said lower plate;
said upper plate including a plurality of indicators each uniquely associated with a different one of said openings in said upper plate and each being adjacent and radially inwards of a respective different one of said openings in said upper plate
a plurality of cylinder assemblies each disposable in said openings to define a polygon having at least three sides and each formed about a respective longitudinal axis and comprised of an even number of cylinder segments numbering at least six; and
each said assembly having opposing end disks, each said disk being rotatably received by a respective one of said recesses and in coaxial alignment with said axis whereby each said cylinder assembly is rotatable about said axis; and
wherein one of said upper and lower plates defines an aperture for viewing different ones of said indicators in the remaining one of said plates when said openings are in said vertical registry whereby said viewed indicators provide indication of relative rotational position of said upper and lower plates, respectively.

9. The apparatus of claim 21, wherein each said cylinder segment further defines an outer surface carrying a number uniquely associated with each said cylinder segment.

10. The apparatus of claim 9, further including:
knob means disposed on said upper plate;
ribbing means disposed on said lower plate, said knob means and said ribbing means being in coaxial alignment with said upper and lower plates; and sound means including said ribbing means for generating an audible indication of said relative rotation between said upper and said lower plates.

11. A manipulative amusement device, comprising:

an upper and a lower plate each independently rotatable about a vertical axis;

a first plurality of half-cylindrical assemblies carried by said upper plate on the outer periphery, each said assembly being comprised of at least three cylindrical segments;

a second plurality of half-cylindrical assemblies carried by said lower plate on the outer periphery, each said assembly being comprised of at least three cylindrical segments;

means for maintaining the positions of said first and second pluralities of said half-cylinderical assemblies on said respective first and second plates when said plates are in a first rotational position;

wherein when said plates are in a second rotational position, said first and second pluralities of half-cylindrical assemblies combine to form a plurality of cylinders each comprised of at least six even-numbered ones of said cylindrical segments; and means for maintaining said combined half-cylindrical assemblies as said cylinders when said plates are in said second rotational position and when said cylinders are rotated about the longitudinal axes of said cylinders; and wherein said longitudinal axes of said cylinders lie about, and in a plane normal to, said vertical axis of said plates.

12. The apparatus of claim 11, further including visual indicator means for indicating the relative rotational position of said upper plate relative to said lower plate.

13. The apparatus of claim 12, wherein when said plates are in said second rotational position to form said plurality of cylinders, said cylinders are disposed on said upper and lower plates at evenly spaced circumferential locations about the periphery of said upper and lower plates;

wherein one of said upper and lower plates includes an indicator spaced radially outwards from said vertical axis;

wherein the remaining one of said upper and lower plates includes a plurality of second indicators each disposed radially outwards of said vertical axis;

wherein each of said second indicators corresponds to a different one of said cylinders; and wherein said second indicators are disposed at evenly spaced circumferential distances about said vertical axis said indicator and said indicators constituting said indicator means.

14. The apparatus of claim 13, wherein each said cylinder segment includes an outer surface carrying a visual indicator uniquely associated with said each cylindrical segment.

15. The apparatus of claim 14, wherein when said upper and lower plates are in said second rotational position, said indicator on said one of said upper and lower plates and one of said plurality of indicators on said remaining one of said upper and lower plates are adjacent.

16. The apparatus of claim 15, wherein said indicator in said one of said upper and lower plates and said plurality of second indicators are spaced substantially the same distance radially outwards of said axis.

17. The apparatus of claim 11, wherein each said cylinder segment includes an outer surface carrying an indicator uniquely associated with said each cylindrical segment.

18. The apparatus of claim 22, wherein different ones of said second indicators are visible through said aperture in functional relation to different corresponding ones of said second positions.

19. The apparatus of claim 18, wherein said second indicators are disposed radially about said axis in the upper surface of said lower plate.

20. A method for playing a manipulative amusement device having an upper and lower plate relatively rotatable about a vertical axis; a first plurality of half-cylindrical assemblies carried by said upper plate on the outer periphery, each comprised of at least three cylindrical segments; a second plurality of half-cylindrical assemblies carried by said lower plate on the outer periphery, each comprised of at least three cylindrical segments; means for maintaining the positions of said first and second plurality of half-cylindrical assemblies when said plates are in a first rotational position; wherein when said plates are in a second rotational position, said half-cylinder assemblies of said first and second pluralities of assemblies combine to form a plurality of cylinders each comprised of at least six even-numbered sections; means for permitting rotation of said cylinders when said plates are in said second rotational position about their longitudinal axes; first indicator means for indicating each of a plurality of said second rotational positions; and second indicator means for uniquely identifying each said cylinder segment; and third indicator means for uniquely identifying each of said cylinders formed when said upper and lower plates are in each of said second rotational positions, said method comprising the steps of:

(a) preselecting a number;

(b) rotating said upper and lower plates into one of said second rotational positions whereby said first indicator means corresponds to said preselected number;

(c) preselecting a next number;

(d) selecting one of said plurality of cylinders in functional response to said third indicator means and said second preselected number;

(e) rotating said selected cylinder in response to the relative positioning of said second indicator means corresponding to each cylinder segment comprising said selected cylinder; and (f) repeating the above steps.

* * * * *